US005950257A

United States Patent [19]

Smith et al.

[11] Patent Number: 5,950,257

[45] Date of Patent: Sep. 14, 1999

[54] MULTI-USE CHILDREN'S PLAY SET

[76] Inventors: Audrey R. Smith, 211 S. State College Blvd., #174; R. Michael Smith, 211 S. State College Blvd., Ste. 174, both of Anaheim, Calif. 92806

[21] Appl. No.: 08/858,254

[22] Filed: May 19, 1997

[51] Int. Cl.[6] ..... A47B 83/04; A47B 17/04; A47C 17/52; A63H 17/00

[52] U.S. Cl. ..... 5/2.1; 5/308; 5/907; 312/204; 312/289; 446/7; 446/71; D6/388; D6/434; D21/433; D21/552

[58] Field of Search ..... 5/2.1, 308, 414, 5/907, 658; 312/204, 330.1, 297, 287, 289, 290, 283, 235.5, 235.2; D6/388, 434; D21/552, 559, 433; 446/7, 71, 230, 478

[56] References Cited

U.S. PATENT DOCUMENTS

| | | | |
|---|---|---|---|
| D. 167,632 | 9/1952 | Jackson | D6/388 X |
| D. 191,364 | 9/1961 | Schoendorf | D6/434 |
| 224,679 | 2/1880 | Green | 5/2.1 |
| D. 252,543 | 8/1979 | Taylor | D6/434 |
| D. 252,718 | 8/1979 | Taylor | D6/434 |
| D. 390,035 | 2/1998 | Suarez | D6/388 X |
| 759,667 | 5/1904 | Canberg | 312/283 |
| 1,127,139 | 2/1915 | West | 312/330.1 X |
| 1,562,205 | 11/1925 | Chempanos | 5/2.1 |
| 2,265,671 | 12/1941 | Quadri | 312/204 |
| 2,567,986 | 9/1951 | Barrett | 5/2.1 |
| 2,615,776 | 10/1952 | Lorentzen | 312/289 |
| 3,285,685 | 11/1966 | Hewett | 312/287 |
| 3,353,865 | 11/1967 | Bass | 312/235.2 X |
| 3,389,410 | 6/1968 | Weigel | 5/2.1 X |
| 4,490,864 | 1/1985 | Wicker, Jr. | 5/2.1 X |
| 5,184,360 | 2/1993 | Gonzalez | 5/2.1 |

FOREIGN PATENT DOCUMENTS

| | | | |
|---|---|---|---|
| 518147 | 11/1955 | Canada | 5/2.1 |

*Primary Examiner*—Michael F. Trettel
*Assistant Examiner*—Robert G. Santos
*Attorney, Agent, or Firm*—James G. O'Neill

[57] ABSTRACT

A multi-use children's play set in the form of a simulated vehicle having an elongated, hollow body with front and rear ends and a pair of sides. One side is designed so as to have a plurality of openings with drawers slidably held therein. One of the drawers holds a futon, and a door is provided in the one side to allow a child to enter and exit from a seating area in the interior of the vehicle. A desk and seat for play or writing is provided at one end, while the front end is hollow and may be used for storage or to hold a further futon or mattress. One or more doors may be provided in the hollow front end of the vehicle to allow access into and out of the hollow interior thereof.

15 Claims, 2 Drawing Sheets

MULTI-USE CHILDREN'S PLAY SET

BACKGROUND OF THE INVENTION

1. Field of the Invention

This invention relates generally to furniture and, more particularly to multi-use furniture for use by children as a combination play set, storage area, study area and bed.

2. Description of the Prior Art

Many types of children's play sets for use indoors are known. Such known play sets may incorporate one or more features, such as a study area, an area for play, and a storage area. Additionally, children's beds are known having lower compartments or lower beds built under a top bed, and lower compartments or beds slide out from underneath the top bed, when it is desired use the same.

Such known play sets and beds, however, are not interchangeable, in that the play sets cannot be used as a bed, and the beds are not designed to be used as a play set. Therefore, there exists a need in the art for a child's play set which has all the advantages of known play sets, together with further uses such as a bed and as fashioned or themed furniture usable with other furniture and/or items having the same theme.

Applicant's present invention is a play set which is specifically designed to provide a child with play, sleeping, studying and storage possibilities. The present invention provides a play set having a plurality of areas for storage, as well as a desk and seating area, numerous access doors and at least one sleeping area, all in a body designed to simulate a vehicle following the fashion or theme in a room where the play set is utilized.

SUMMARY OF THE INVENTION

Accordingly, it is a general object of the present invention to provide an improved children's play set. It is a particular object of the present invention to provide an improved children's play set having a plurality of pull-out drawer means. It is a more particular object of the present invention to provide an improved children's play set including a number of diverse features therein. It is a further particular object of the present invention to provide an improved children's play set having a plurality of storage compartments, with a bed held in one of the storage compartments; as well as a desk and seating arrangement, a storage area for toys; and a simulated vehicle play area wherein a number of children may be seated. It is another particular object of the present invention to provide an improved children's play set in the shape of a vehicle having a plurality of storage compartments and a bed, which may be slid into and out of an area within the play set, and at least one opening door and a seating area within a central space for a number of children.

In accordance with one aspect of the present invention, there is provided a body having a base, two ends and two sides, designed so as to simulate a vehicle with a plurality of sliding drawer means on one side thereof, movable into and out of a hollow inner area. One of the drawer means includes a bed arrangement held therein; a foldable desk means and slidable seat means are held at one end of the body, while door means are formed at the other end for the storage of toys or holding a bed therein.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description taken in connection with the accompanying drawings, in which:

DESCRIPTION OF THE PREFERRED EMBODIMENT

Figure 2:
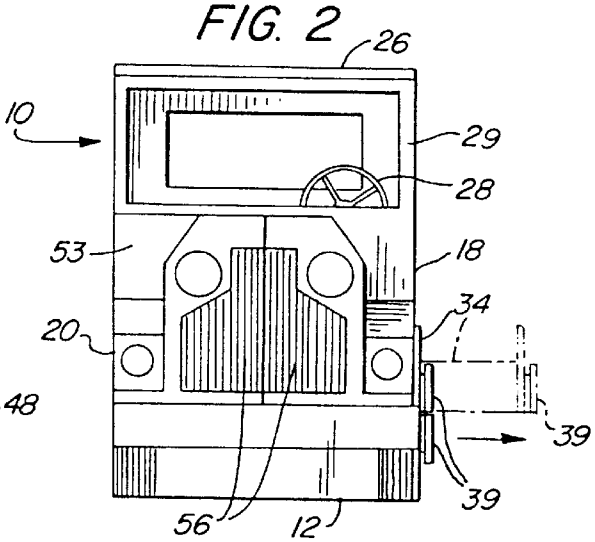
FIG. 2 is a front elevational view of the play set of FIG. 1, with one of the drawer means shown in the open position in broken line.
Figure 4:
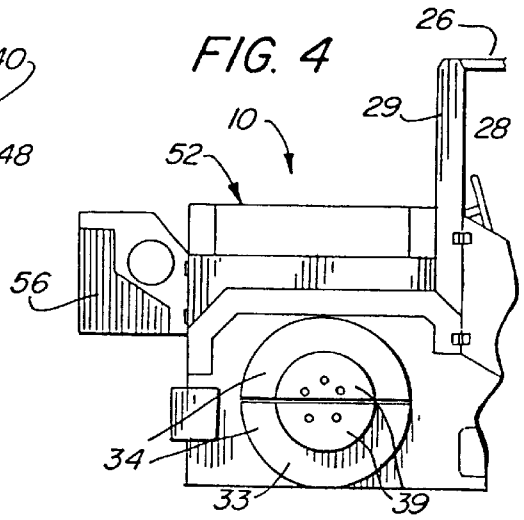
FIG. 4 is a partial view similar to that of FIG. 1 with a front door into the hollow interior of the front hood area shown in the open position.

The following description is provided to enable any person skilled in the art to make and use the invention and sets forth the best modes contemplated by the inventors of carry out their invention. Various modifications, however, will remain readily apparent to those skilled in the art, since the generic principles of the present invention have been defined herein specifically to describe a child's play set having a plurality of separate components therein.

It is to be understood that the present invention is drawn to theme-type children's furniture, in the form of a vehicle having simulated front and rear wheels. Examples of such vehicles are an off-road utility vehicle, a school bus, a truck, or the like. Other modes of conveyance could also be simulated, if desired. Several embodiments of types of vehicle will be described in connection with the play set, however, it is to be understood that any type of vehicle or conveyance, pleasing to a child, could be designed and used within the parameters of the claims of the present invention. The furniture of the present invention is designed to be used indoors, and is sized and dimensioned to fit in a child's bedroom or play room, with varying sized play sets used for children of different ages.

Turning now to the drawings, there shown is a simulated vehicle 10, in the form of a pick up truck. The vehicle 10 preferably has an elongated, substantially rectangular body with a base 12, a flat rear end or face 14, a flat front end or face 16, a first side 18, a second side 20, and a hollow interior 22. The hollow interior 22 may be open or provided with a floor, not shown. Also, if desired, seating means 24, may be added in an area similar to a pick up cab, covered by a roof or the like 26. A steering wheel or other mechanism 28, capable of being turned by a child is mounted to a windshield area 29 of the cab of the pick up, in front of seat 24. Behind the seating area 24, within the interior 22, is a bed 30 of the pick up. This bed 30 may be used for play or storage. The seating area 24 may be entered by one or more door means 32, rotatably mounted to the windshield area 29. The other end of the door may be held or locked to a rear wall 31 of the pick up cab. A plurality of drawer means, such as 34, 36, 38 are shown as being slidably held within the side 18, and are movable into and out of the hollow interior of the vehicle 10 through the side 18 thereof. The drawer means are preferably located under a floor in the front hood area, the pick up cab, and the pick up bed 30.

As shown, each of the drawer means 34 are decorated and/or shaped so as to form one-half of a simulated front tire and wheel 33, while each of the drawer means 38, are decorated and/or shaped so as to form one-half of a simulated rear tire and wheel 37. As shown most clearly in FIGS. 2 and 3, each of the drawer means 34 and 38 include pull handles 39, 41 decorated and/or shaped so as to simulate one-half of the vehicle wheels 33, 37.

Figure 3:
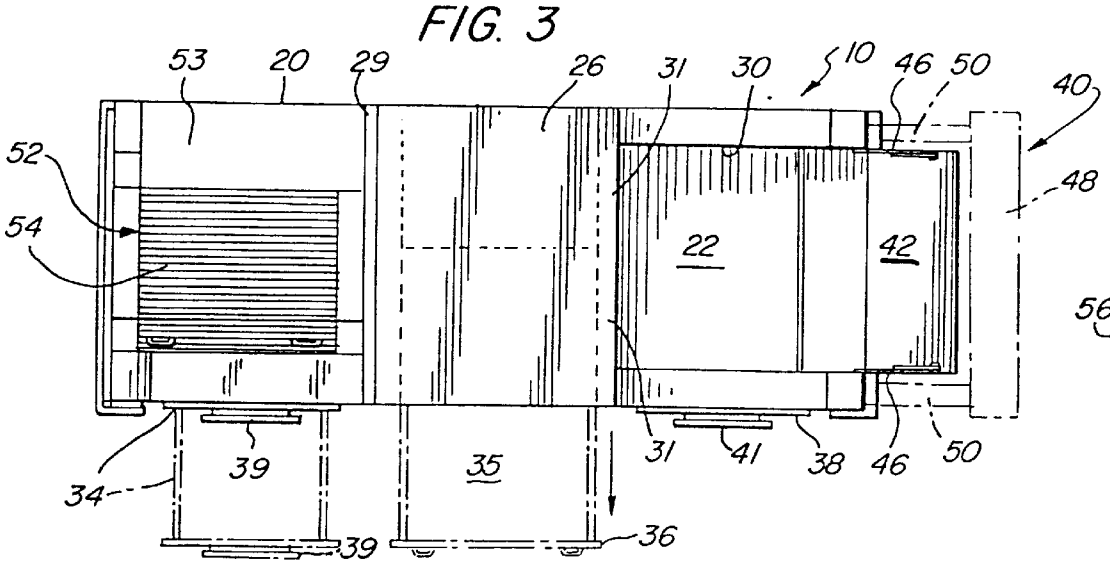
FIG. 3 is a top plan view of FIG. 1 with a plurality of the drawer means, and a seat means shown in broken line.
Figure 5:
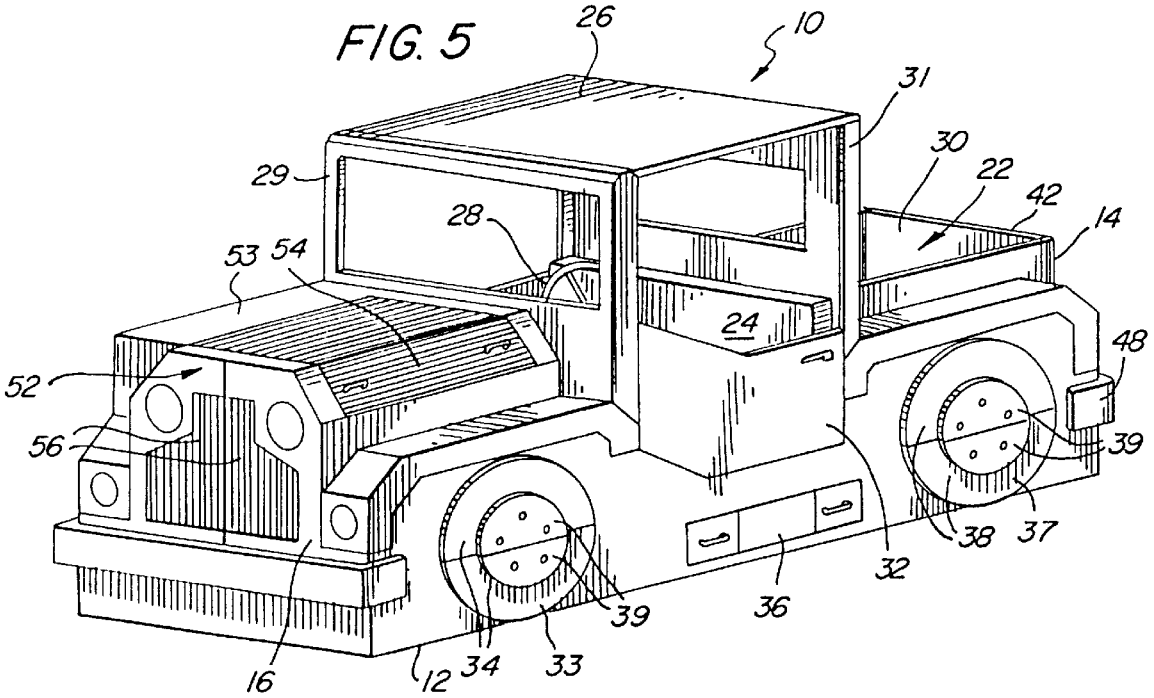
FIG. 5 is a perspective view of the play set shown in FIG. 1.

As best shown in FIG. 3, the central drawer 36, preferably extends entirely across the width of the body of the vehicle 10, and includes a futon or mattress 35 therein. Therefore, when pulled out far enough so as to entirely expose the futon or mattress 35, the drawer 36 may serve as a bed.

Figure 1:
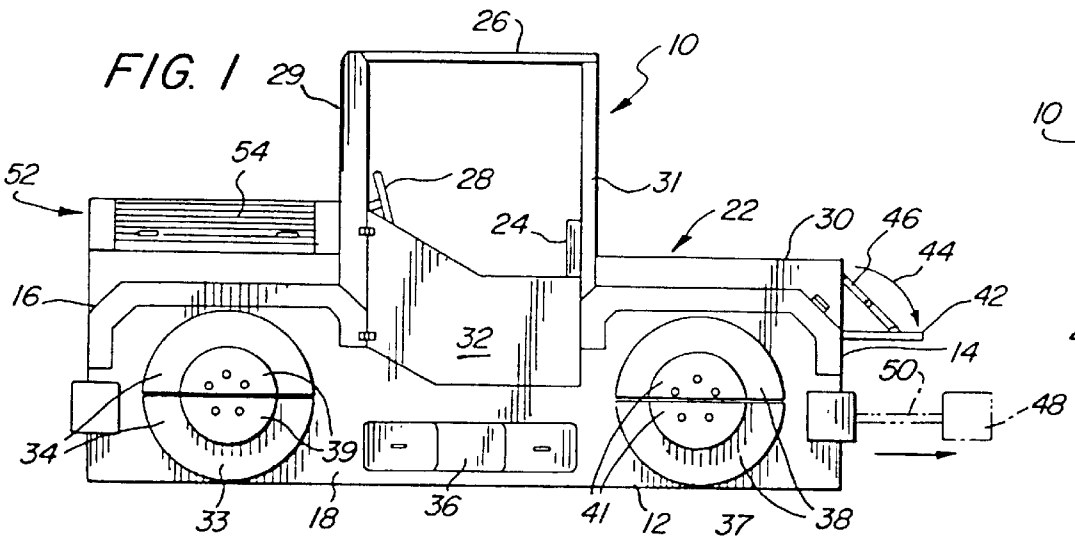
FIG. 1 is a side elevational view of one embodiment of the children's play set of the present invention.

As shown best in FIGS. 1 through 3, a desk means 40 is formed by a substantially flat means 42, such as a rotatable rear end or tail gate portion of the vehicle 10. The flat means 42 is normally held in the vertical position so as to form a portion of the rear end of surface 14, such as the tail gate of the pick up shown, or a back door of another vehicle. However, when the flat means 42 is released and rotated downwardly, in the direction of the arrow 44, away from the rear surface 14, this flat means 42 forms a vertical play or writing surface, for use by a child. The flat means 42 includes a pair of hinge means 46, one on each side thereof, to enable the flat means to be moved between the horizontal and vertical positions, and to hold the flat means in place, when in either position.

The rear surface 14 also includes a substantially square, elongated bumper/seating means 48. This substantially rectangular bumper/seating means is normally held within a cavity or opening formed in the flat rear surface 14, and is extendable or slidable outwardly therefrom, on slide means 50, so as to form an elongated bench or seating means for one or more children. The bumper/seating means is preferably provided, or covered with, a cover or cushioning means, at least on the top surface thereof, to provide a more comfortable surface for children seated thereon. The slide means 50 is sized and dimensioned to provide sufficient strength to hold the seat 48 and any children thereon when in the outer vertical position, shown in broken line in FIGS. 1 and 3. Additionally, the slide means 50 must be sized and dimensioned so as to allow sufficient space in the center thereof to allow one or more children sitting on the top surface of the bench/seating means 48 to hang their legs downwardly when seated under or in front of the writing surface 42, facing the rear face 14.

A front portion 52 of the vehicle 10, forward of the cab area, is preferably formed so as to be hood-shaped and hollow, and includes a plurality of doors therein. These doors preferably comprise a rotating or sliding accordion-type door 54 at the top of the hood shaped portion 52, and one or more swinging front doors 56, in a grill area of the simulated vehicle, to allow access to the hollow interior of this hood shaped area, for storage or removal of items or toys. A separate toy box or other storage means (not shown) may be held within the hollow interior of this hood shaped area 52.

It should be noted that the play set of the present invention may be shaped as a vehicle on both sides, or on only the side 18 with the drawers therein. That is, if the play set is pushed up against a wall in any room, only the side with the drawers thereon would be facing outwardly, and the side against the wall would not need any decoration, etc. However, if used free standing in the middle of a room, both sides of the play set 10 may be decorated to appear as a vehicle, but still only one side would contain the drawers. Furthermore, the rear or back side 20, to be place against a wall, may include an elevated, enlarged area 53 on the front end thereof, to allow the sliding door 54 to be moved into and held therein, and to provide an enlarged portion within the hollow interior.

Figure 6:
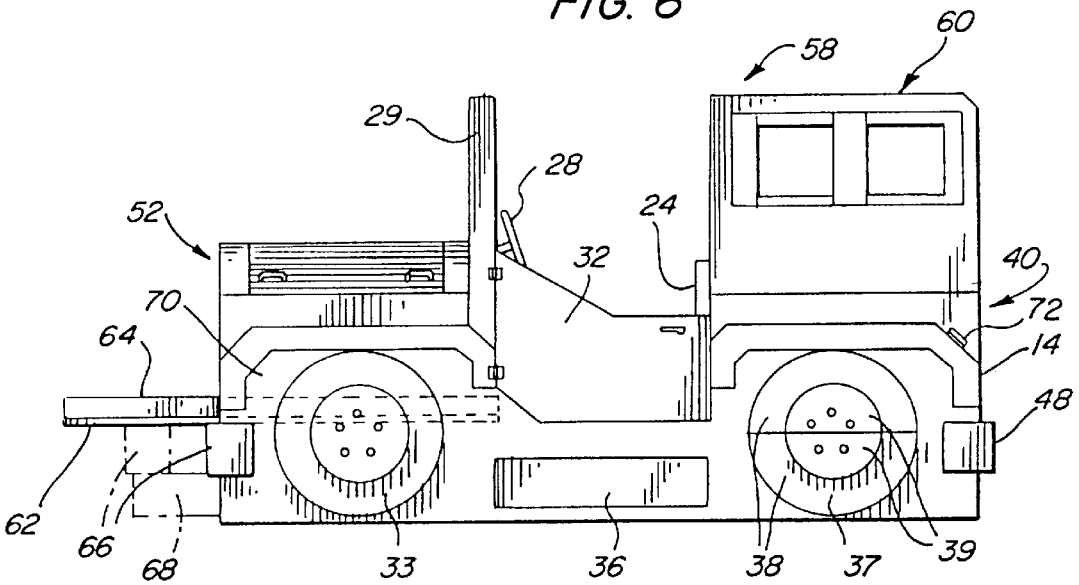
FIG. 6 is a side elevation view of a further embodiment of a play set having an optional bed held within the front hood area.

Turning now to FIG. 6, there shown is a further embodiment of a vehicle 58. The interior area 22 may be provided with the seat means 24, or the seating means 24 may be removed and side seating means (not shown) may be provided in a rear portion 60 thereof. The front seating area 24 thereof may also be entered by a door means 32. The rear area 60 may be covered or uncovered, if desired, and the front portion over the seating means may be provided with a roof such as 26, or be open, as shown in FIG. 6. If the roof is open, the windshield area 29 in front of the steering wheel 28 will still be utilized, but the rear wall 31 of the cab shown in FIG. 1 will be removed to allow access into the rear portion 60. The central drawer 36, and futon or mattress 35, are used, as provided in the first embodiment. However, the front drawers 34 are eliminated and only a decal or other type of decoration is used to simulate a front wheel 33. The front hood shaped area 52 no longer includes the sliding or rotating door 54 or the front doors 56. Instead, a single door 62, movable between a horizontal position, as shown in solid line in FIG. 6, and a vertical position in a front grill of the vehicle, is provided. In the horizontal position, the single door 62 supports a futon or mattress 64 held in the hollow interior 70 of the hood-shaped front, to form a further bed in the play set. The front face 16 of the vehicle 58 also includes a front bumper means 66, similar to the rear seating means 48, but preferably without a covering thereon. This front bumper means 66 is also movable outwardly, to the position shown in broken line, to support the front door 62 and mattress 64. If desired or needed, a further front sliding means 68 may be provided in the base of the vehicle 58. This sliding means 68 may also be extended outwardly to support the front bumper 66 and provide further support to the door 62 and mattress 64. As shown, the mattress 64 extends into the hollow area 70 under the front hood means 52 up to the front of the seat area of the vehicle.

Each of the play sets 10 and 58 may be provided with further accessories or play items, on the simulated vehicle, such as license plate holders, windshield wiper blades and/or mirrors. Similarly, the interior area may be provided with a CD player, a radio or tape deck. Additionally, a simulated gas cap, such as shown at 72, may be provided with an opening, connected to a tube or the like, which is in turn connected to a box or container locked or sealed in the body of the vehicle, to be used as a piggy-type bank.

It, therefore, can be seen that the play set of the present invention provides various activity and sleeping areas for children. For example, one or more children may enter the vehicle 10 or 58, through one or more doors 32, and play at driving or being a passenger in the vehicle. Toys and/or other items may be put into or taken out of any of the drawers or storage areas. One or more children may lie down on, and, if possible, sleep on either or both futons or mattresses 35, 64. Or one or more children may utilize the bench seat 48 and/or play/writing surface 42.

Those skilled in the art will appreciate that the above-described preferred embodiments are subject to numerous modifications and adaptations without departing from the scope and spirit of the invention. Therefore, it is to be understood that, within the scope of the appended claims, the invention may be practiced other than is specifically described herein.

What is claimed is:

1. A child's multi-use play set comprising, in combination:

an elongated body in the shape of a simulated vehicle;

the elongated body having a base, a first end and a second end, a first side and a second side, and a hollow interior;

the first end having a desk and a desk seat formed therein;

the second end being formed as a simulated vehicle hood with an open interior;

a steering wheel held in the hollow interior in front of a simulated windshield formed on the elongated body;

the first side having a door opening and a plurality of drawer openings formed therein;

a door movably mounted in the door opening;

a seat held in the hollow interior, adjacent the movable door and the simulated windshield whereby opening of the door allows access to the seat in the hollow interior adjacent the steering wheel;

a plurality of drawers slidably mounted in the plurality of drawer openings; and one of the drawers having a futon or mattress held therein to form a bed slidable in and out of the first side with the one of the drawers.

2. The child's play set of claim 1 wherein the elongated body includes simulated tires and wheels on at least the first side, and the plurality of drawers include at least one pair of drawers having pull handles shaped as one half of a simulated wheel for a vehicle.

3. The child's play set of claim 2 wherein there are two pairs of drawers with pull handles shaped as one-half of simulated wheels for a vehicle, with the two pairs being slidably mounted in the drawer openings adjacent the first and second ends of the elongated body.

4. The child's play set of claim 1, further including at least one door in the simulated vehicle hood allowing access to the open interior.

5. The child's play set of claim 4 further including a futon or mattress held in the open interior of the simulated vehicle hood and supported in a horizontal position in the open interior and by the at least one door, when the at least one door is in a horizontal position.

6. The child's play set of claim 5 further including slidable support extendable from the second end, to aid in supporting the at least one door in the horizontal position.

7. The child's play set of claim 1 wherein the desk comprises a flat element held in the first end which flat element is foldable outwardly to a horizontal position, and the desk seat is an elongated surface in the form of a simulated bumper slidable into and out of the first end.

8. The child's play set of claim 7 wherein the elongated body includes simulated tires and wheels on at least the first side, and the plurality of drawers include at least one pair of drawers having pull handles shaped as one half of a simulated wheel for a vehicle.

9. The child's play set of claim 8 wherein there are two pairs of drawers with pull handles shaped as one-half of simulated wheels for a vehicle with the two pairs of drawers being adjacent the first and second ends of the elongated body.

10. The child's play set of claim 9 further including at least one door in the simulated vehicle hood.

11. The child's play set of claim 10 further including a futon or mattress held in the open interior of the simulated hood and supported in a horizontal position in the open interior and by the at least one door, when the at least one door is in a horizontal position.

12. The child's play set of claim 11 further including a slidable support extendable from the second end, to aid in supporting the at least one door in the horizontal position.

13. A child's multi-use play set comprising, in combination:

an elongated, substantially rectangular body in the shape of a simulated vehicle;

the elongated, substantially rectangular body having a base, a first end, a second end, a first side and a second side, bounding a hollow interior;

the first end having a desk comprising a foldable flat surface and a desk seat comprising an extendable elongated element in the form of a simulated bumper formed therein;

the second end being formed as a simulated vehicle hood with an open interior and at least one door formed in the simulated vehicle hood;

the first side having a door opening and a plurality of drawer openings formed therein;

a door movably mounted in the door opening;

a seat held in the hollow interior, adjacent the movable door;

a steering wheel mounted to a simulated windshield in the hollow interior, adjacent the seat;

a plurality of drawers slidably mounted in the plurality of drawer openings; and one of the plurality of drawers having a futon or a mattress held therein to form a bed slidable in and out of the first side, and at least two other of the plurality of drawers forming simulated vehicle tires and wheels.

14. The child's play set of claim 13 further including a futon or mattress held in the open interior of the simulated hood and supported in a horizontal position therein by the at least one door when the at least one door is in a horizontal position and a slidable support extendable from the second end to support the at least one door, supporting the futon or mattress.

15. A child's multi-use play set comprising, in combination:

an elongated, substantially rectangular body in the shape of a simulated pick up;

the elongated, substantially rectangular body having a base, a first end, a second end, a first side and a second side, bounding a hollow interior;

the first end having a desk and a desk seat formed therein;

the desk comprising a foldable flat tail gate and the desk seat comprising an extendable bumper forming an elongated seating surface;

a steering wheel held in the hollow interior in front of a simulated windshield held on the elongated body;

the second end being formed as a simulated vehicle hood with an open interior and a pair of doors formed in the simulated vehicle hood for access to the open interior;

the first side having a door opening and a plurality of drawer openings formed therein;

a door movably mounted in the door opening;

at least one seat held in the hollow interior and being accessible through the door;

a plurality of drawers slidably mounted in the plurality of drawer openings;

one of the plurality of drawers having a futon or a mattress held therein to form a bed slidable in and out of the first side; and the remainder of the plurality of drawers being in the form of simulated vehicle tires and wheels, and further including pull handles in the form of the simulated wheels.

* * * * *